United States Patent [19]

Lopes, Jr. et al.

[11] 4,096,713

[45] Jun. 27, 1978

[54] KNITTING NEEDLE

[75] Inventors: Antone Lopes, Jr.; Richard Wilton Shepard, both of Torrington, Conn.

[73] Assignee: The Torrington Company, Torrington, Conn.

[21] Appl. No.: 822,446

[22] Filed: Aug. 8, 1977

[51] Int. Cl.[2] ..... D04B 35/04

[52] U.S. Cl. ..... 66/121

[58] Field of Search ..... 66/121, 122; 163/2, 163/3

[56] References Cited

U.S. PATENT DOCUMENTS

| | | | |
|---|---|---|---|
| 749,686 | 1/1904 | Egly | 66/121 |
| 773,722 | 11/1904 | Egly | 66/121 |
| 2,282,824 | 5/1942 | Primm | 66/121 |
| 3,145,550 | 8/1964 | Bennett | 66/121 |

FOREIGN PATENT DOCUMENTS

| | | | |
|---|---|---|---|
| 1,585,099 | 4/1972 | Germany | 66/121 |
| 4,618,309 | 5/1971 | Japan | 66/121 |
| 930,717 | 7/1963 | United Kingdom | 66/121 |

*Primary Examiner*—Mervin Stein
*Assistant Examiner*—A. M. Falik
*Attorney, Agent, or Firm*—Frank S. Troidl

[57] ABSTRACT

This knitting needle is a latch needle of the male latch-female hook type. The shape of the groove in the hook and the shape of the latch is such that during the initial use of the needle, only the end of the inner surface of the latch contacts the bottom surface of the groove. The amount of the surface of the inner portion of the latch which contacts the groove bottom surface gradually increases as the groove bottom surface and the inner surface of the latch are worn by use.

6 Claims, 7 Drawing Figures

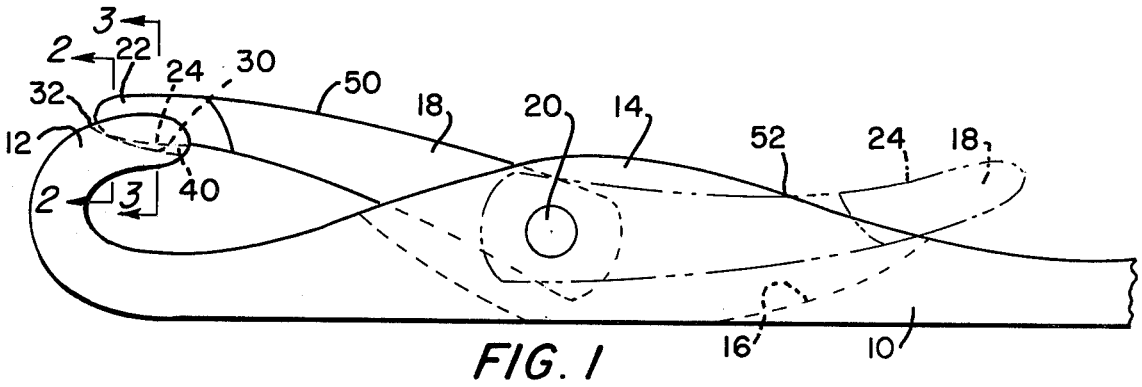
FIG. 1
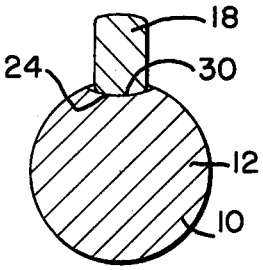
FIG. 2
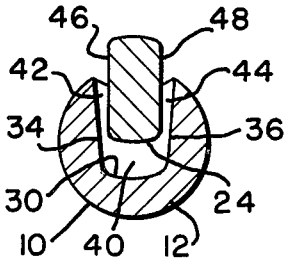
FIG. 3
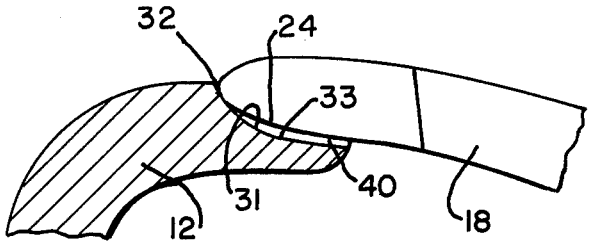
FIG. 4
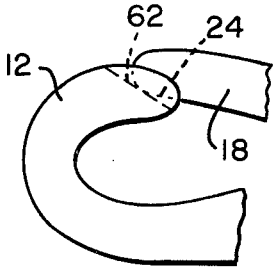
FIG. 6
FIG. 5
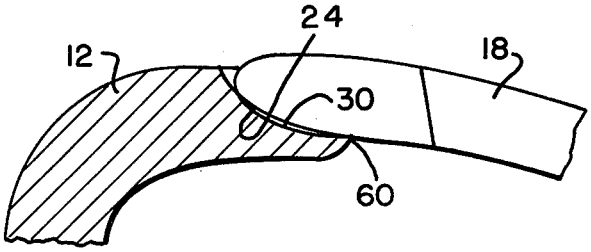
FIG. 7
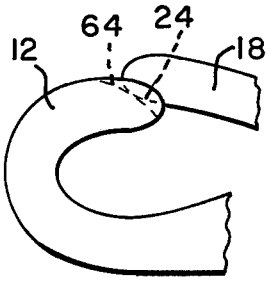

KNITTING NEEDLE

This invention relates to knitting needles. More particularly, this invention is a new knitting needle of the male latch-female hook type.

In using pivoting latch knitting needles, the free end of the latch tends to slide sideways on the hook as the latch closes and then get under the hook, rendering the needle unserviceable because the latch will no longer open. The solution is usually to provide a concave area on one of these parts which fits over a convex area on the other part.

Normally the noucat on the free end of the latch is the female or concave spoon part and the hook the male or convex part. This arrangement has worked well for years and will continue to do so in many applications.

There are, however, some knitting machines which leave very little lateral space between machine elements for the latch to move through in its swing from open position to closed position, and back. As the needle wears and the latch becomes looser in its groove, the latch noucat starts to rub the other adjacent machine parts and wear away. When it does, sharp edges are produced which cut and fray the yarn as the yarn loop slides over those edges. This results in the needle making defective fabric with frayed lines in it.

Many solutions have been attempted. Well-made grooves for the latch in the needle blade help. Welded pivots improve the needle construction. Needle straightness is very important in cutting down contact wear. Attempts have been made to make the latch narrower to increase clearance, but this is very difficult because the latch is usually the female part and cannot be narrower than the hook since it must overlie the hook. The solution then seemed to be to make the latch the narrow male member.

J. C. Egly was granted U.S. Pat. No. 749,686 on Jan. 12, 1904 and U.S. Pat. No. 773,722 on Nov. 1, 1904. Egly turned the problem inside out, making the hook the female member and the latch the male member. The latch could be narrower and thus avoid rubbing machine parts. However, the needles were not satisfactory. As wear took place between latch and hook and between latch and pivot, the latch when closed would seat beneath the top surface of the hook, allowing the edges at the end of the hook or on the slot to damage the yarn which was drawn taughtly along the needle. In the latch-open position, the yarn was drawn taughtly over the sharp edges developed at the inside bottom end of the latch.

Many years later J. P. Primm was granted U.S. Pat. No. 2,282,824 on May 12, 1942 claiming another male latch-female hook type needle. Primm's needle will work for a short time and is better than Egly's needle because the latch surface is higher over the hook when the needle is new, and the groove edges are rounded, so the yarn can be drawn smoothly over the needle. However, this needle too developed a step with a sharp edge on the inside of the latch, as wear took place between latch and hook, and the yarn was damaged in sliding over this edge in the latch-open position.

Still later, W. Bennett was granted U.S. Pat. No. 3,145,550 describing a needle similar to the needle of Primm. Bennett also failed to develope a needle which will run satisfactorily in a knitting machine for the desired length of time. He provided a large contact area between latch and hook to distribute the impact forces and reduce wear, but inevitably a yarn-damaging step with a sharp edge was produced on the inside of the latch at the end of the hook. Also, because he started with the outside surface of the latch flush with the surface of the hook, the wear gradually lowered the latch beneath the surface of the hook, allowing the yarn to abrade against the top end edge of the hook and the top edges of the groove as the yarn was drawn over them.

It is the errors in all of the above-mentioned patents which explain why latch needles are not, in generaly, made as shown by Egly, Primm or Bennett. A few are made, but the majority are still of the original style of female latch-male hook.

An industrial knitting needle is subject to wear due to the usual factors of motion impact, friction, abrasion from dirt, lack of cleaning, and lack of lubrication. The needle is an expendable part; it is expected to wear out. It is not judged on whether it wears out, but rather on how long it takes to wear out. How long it takes to wear out depends on its construction. It is desirable to produce good knit material with undamaged yarn throughout the operating life of the needle, and extend that operational life as long as possible.

One of the basic ideas of needle construction is that all impact surfaces be out of the yarn handling contact area. The yarn handling contact area is defined as any part of the needle which the yarn touches. Impact areas get sharp, rough, worn, or otherwise out of shape, and can fray the yarn. Therefore, impact areas should be confined to non-yarn handling areas. In the regular latch construction, this is done. The usual male hook and female latch construction obeys this rule very well. The impact area of the hook is covered by the latch as the yarn slides over it while the latch is closed. When the latch is open, the yarn slides along the latch surface alongside the concavity and never touches the impact surface which is in the depressed concave area.

However, despite the fact that the traditional needle construction protects the yarn from damage by sliding in contact with the impact areas, one or each side of the latch can and does contact other machine parts and becomes worn and develops sharp edges, and when so worn can fray the yarn. The Egly-Primm-Bennett type needles with a smaller male latch help avoid this problem for a short time, but fail to fulfill the requirement of wearing out in a long, slow, and serviceable manner.

In the male latch-female hook type pivoting latch knitting needle, there is no way to hide the wear of the latch impact area from the yarn. However, what can be done is to construct that area so the wear is not able to damage the yarn, and that is what we have done. The wear in the hook is hidden from the yarn, but the wear on the latch is exposed to the yarn. Therefore, the wear is controlled in its shape and its smoothness as it progresses during the life of the needle.

Our invention is a new latch needle of the male latch-female hook type where the shape of the latch where it contacts the yarn and the shape of the groove are controlled and maintained smooth during the life of the needle, assuring that the needle will not be withdrawn from service due to yarn damage from a worn latch before the needle has failed in some other way. We thus extend useful needle life.

Briefly described, this new latch needle comprises a blade with a hook on one end of the blade. The hook has a longitudinal groove formed on its outer perimeter. The groove extends from a point on the outer perimeter of the hook longitudinally spaced from the free end of the hook up to the free end of the hook. The free end of the latch is provided with an inner surface formed to seat in the groove of the hook. The position and shape of the latch and the shape of the groove are such that only the end portion of the inner surface of the latch contacts the bottom surface of the groove when the needle is new. The contact point is near the point where the groove begins. As the needle is used and the latch and groove surfaces wear together, the area of the inner surface of the latch contacting the groove bottom surface gradually increases in size at a continually decreasing rate as the impact is spread over the larger area. With this structure, the service life of a male latch-female hook type needle is greatly increased. The latch and groove bottom wear together until they are in mating contact right to the free end of the hook. If the needle design is correct, this will occur at approximately the same time that the needle fails for some other reason. Thus no step or shoulder with a sharp edge will appear on the latch because of further impact wear of latch against hook, and thus there is no edge to damage yarn sliding over an opened latch.

The invention as well as its many advantages may be further understood by reference to the following detailed description and drawings in which:

FIG. 1 is a fragmentary side view illustrating a latch needle according to the present invention;

FIG. 2 is a sectional view, on a enlarged scale, taken along lines 2—2 of FIG. 1 and in the direction of the arrows;

FIG. 3 is a sectional view, on an enlarged scale, taken along lines 3—3 of FIG. 1 and in the direction of the arrows;

FIG. 4 is a fragmentary view, partly in section, showing the contact area of the latch and the hook when the needle is new;

FIG. 5 is a view similar to FIG. 4 showing the contact area of the latch and the hook after the needle has become worn and its service life is about over;

FIG. 6 is a fragmentary view showing the hook and latch structure of a second preferred embodiment of the invention; and FIG. 7 is a fragmentary view showing a hook and latch construction of still another preferred embodiment of the invention.

In the various Figures, like parts are referred to by like numbers.

Referring to the drawings and more particularly to FIG. 1, the new pivoting latch knitting needle includes a blade 10 with a hook 12 on one end of the blade. The blade 10 is provided with a cheek section 14 in which is provided a slot 16 indicated by the broken lines.

A latch 18 has one end pivotally connected to a pivot 20 located in the slot 16. The closed position of the latch 18 is shown in full lines, and the open position in broken lines.

A noucat 22 is provided on the free end of the latch 18. The noucat 22 is wider in lateral cross-section than the remainder of the latch, although this section of the latch may alternatively be tapered or flat and the same width as the body of the latch or thinner than the body of the latch.

The latch 18 has at its free end an inner surface 24 formed to seat in a groove formed on the outer perimeter of the hook 12. The groove has a bottom surface 30 which is curved in lateral cross-section (see FIG. 2 and FIG. 3). It may alternatively be flat on the bottom with rounded lateral corners. The bottom surface 30 extends from a point 32 on the outer perimeter of hook 12 longitudinally spaced from the free end of the hook up to the free end of the hook. This free end of the hook is shown rounded, but it may equally well have other shapes.

The groove is defined by the bottom surface 30 and side walls 34 and 36. The groove side walls continually decrease in height from the free end of the hook toward point 32 and are substantially non-existent adjacent point 32. A space 40 is provided between most of the curved portion 24 and the bottom surface 30 of the groove while the latch is pressed against the hook, and operating clearance spaces 42 and 44 are provided between the sides 46 and 48, of latch 18 and the walls 34 and 36, respectively. The sides 46 and 48 may be tapered outwardly to help guide the latch into its seat in the groove. There may be a mating fit of the side walls of the top latch with the walls 34 and 36.

The profile of the inner surface 24 of the latch is shaped to guide the yarn smoothly over the hook as in the conventional latch needle when the latch is open and the yarn is moving to the right in FIG. 1. The outer surface 50 of the latch extends above the outer surface of the hook when the latch is in the latch-closed position and is never completely hidden in the hook 12 even after the latch and groove bottom have worn together, until the needle is at or near the end of its operating life. The outer surface carries the yarn in this latch closed position and prevents its contacting the edges of the groove which might cause fraying and damage as the loop of yarn slides to the left in FIG. 1.

In the specific embodiment shown in FIGS. 1 through 5, the bottom surface 30 of the groove is concave in lateral cross-section and the inner surface 24 of the latch is convex in lateral cross-section, as shown in FIGS. 2 and 3, although they might either or each have flat bottoms with rounded corners and/or edges. The bottom surface 30 of the groove has at least a portion in the shape of a concave curve in longitudinal cross-section. As shown in FIG. 4, the bottom surface 30 may include a curved portion 31 in longitudinal cross-section and an angled straight portion 33 in longitudinal cross-section. If desired, the bottom surface 30 could be the arc of a true circle in longitudinal cross-section, or any other desired curve or set of curves.

The portion of the surface 24 encompassed by the hook 12 is concealed by the hook when the latch is closed. The shape of the surface 24 depends upon the requirements of the loop of yarn as it slides over the open latch which is shown by the broken lines in FIG. 1. The loop of yarn must slide along the surface 24 from the point indicated by the numeral 52 to the end of the latch without meeting any steps, edges, sharp places, or other features which will damage the yarn.

Machine knitting needles operate hundreds of times per minute. Fractions of a second after the latch 18 is in the open position, the latch is swung to the closed position and the same surface 24 is slammed down on the hook 12. While the damaging affects of the impact on the hook surface will be hidden from the yarn because the hook is the female part and the impact is inside the groove, the affects or damage cannot be hidden on surface 24 since the latch is immediately returned to the open position and the impact damage, if any, on surface 24 is presented to the yarn. This is where the other needles mentioned above fail and our new needle succeeds. We control the impact damage and wear on surface 24 so that this surface is always smooth and rounded for the yarn to slide over.

When the needle is new, only the end portion of the inner surface of the latch contacts the bottom surface 30 of the groove, as shown in FIG. 4. The tip of the latch 18 will wear in a compound curve. The wear will leave a smooth curve which will not be damaging to the yarn. So will the surface of the groove wear, but this wear area does not contact the yarn and can be ignored. Eventually, the needle will wear to look as shown in FIG. 5.

In FIG. 5 the two impact surfaces on the latch and the groove wall have worn to the point where they are in complete contact along the entire longitudinal length of the groove except near the starting point of the groove, and possible even there with some needle structure. Only now is there the possibility that further wear will cause a yarn damaging step near point 60 where part of the latch 18 is worn by the hook 12 and part is not. Proper design of the latch and hook will assure that the needle will have given its maximum operating life service by the time the condition shown in FIG. 5 is reached. Overall useful life of the knitting needle is thus extended beyond the life cycle of prior designs.

In the embodiment shown in FIG. 6 the groove 62 in the hook is concave in lateral cross-section and extends at a constant angle in longitudinal cross-section.

In the embodiment shown in FIG. 7 the groove 64 is concave in lateral cross-section and is in the shape of a reverse curve in longitudinal cross-section.

The operation of the embodiments shown in FIG. 6 and FIG. 7 is substantially the same as the operation of the embodiment shown in FIGS. 1 through 5, in that initially only a small part of the tip of the latch contacts the bottom wall of the groove with the amount of contact gradually increasing as the needle is used. In lateral cross-section the latch surfaces 24 will still present rounded contours to the yarn. However, these two embodiments do not give as good results as does our preferred embodiment with its concave curve as viewed in longitudinal section, because the wear between latch and groove surface will tend to produce a large obtuse angle on the latch with an edge, albeit not a sharp edge, over which the yarn must slide in the latch-open position, but they are still better than the abrupt step produced by prior art structures.

We claim:

1. A latch needle comprising: a blade; a hook on one end of the blade, said hook having a groove formed on its outer perimeter, the groove having a bottom surface extending from a point on the outer perimeter of the hook longitudinally spaced from the free end of the hook up to the free end, and a latch having one end pivotally connected to the blade, said latch having its free end provided with an inner surface formed to seat in the groove of the hook, the shape of the groove and the shape of the latch being such that initially only the end portion of the inner surface of the latch contacts the bottom surface of the groove in the latch closed position near said point on the outer perimeter of the hook with a remaining part of the inner surface of the latch located in the groove being spaced from the bottom surface of the groove, that portion of the inner surface of the latch coming into contact with the groove bottom surface gradually increasing in area as the groove bottom surface and the inner surface of the latch wear together during needle operation.

2. A latch needle in accordance with claim 1 wherein: the bottom surface of the hook is curved in lateral cross-section; and the inner surface of the latch is shaped to have a curved smooth surface with the extreme end of the curved surface adapted to contact the bottom curved surface of the groove, and the outer surface of the free end of the latch is located outwardly from the groove when the latch is seated in the groove.

3. A latch needle in accordance with claim 2 wherein: the bottom surface of the groove is concave in lateral cross-section and the curved inner surface of the latch is convex in lateral cross-section.

4. A latch needle in accordance with claim 3 wherein: the bottom surface of the groove has at least a portion in the shape of a curve in longitudinal cross-secton.

5. A latch needle in accordance with claim 3 wherein: the bottom surface of the groove extends at a constant angle in longitudinal cross-section.

6. A latch needle in accordance with claim 3 wherein: the bottom surface of the groove is a reverse curve in longitudinal cross-section.

* * * * *